US007908872B2

(12) United States Patent
Williams et al.

(10) Patent No.: US 7,908,872 B2
(45) Date of Patent: Mar. 22, 2011

(54) RARE-GAS-BASED BERNOULLI HEAT PUMP AND METHOD

(75) Inventors: Arthur R. Williams, Worcester, MA (US); Charles C. Agosta, Worcester, MA (US)

(73) Assignee: MachFlow Energy Inc., Worcester, MA (US)

( * ) Notice: Subject to any disclaimer, the term of this patent is extended or adjusted under 35 U.S.C. 154(b) by 204 days.

(21) Appl. No.: 11/498,887

(22) Filed: Aug. 3, 2006

(65) Prior Publication Data

US 2008/0028774 A1 Feb. 7, 2008

(51) Int. Cl.
*F25B 9/00* (2006.01)

(52) U.S. Cl. ..... 62/87; 62/324.1; 62/324.2

(58) Field of Classification Search ..... 62/87, 114, 62/401, 402, 639, 923, 924, 925; 313/576, 313/641, 642; 264/676; 534/7; 96/275, 96/323; 73/1.26; 128/204.25; 137/115.11
See application file for complete search history.

(56) References Cited

U.S. PATENT DOCUMENTS

| | | | | |
|---|---|---|---|---|
| 2,223,429 | A | 12/1940 | Smith et al. | |
| 2,441,279 | A * | 5/1948 | McCollum | 165/41 |
| 2,544,299 | A | 3/1951 | Damon et al. | |
| 2,857,332 | A | 10/1958 | Tenney et al. | |
| 3,010,799 | A | 11/1961 | Ecal | |
| 3,049,891 | A | 8/1962 | Barkelew | |
| 3,200,607 | A | 8/1965 | Williams | |
| 3,334,026 | A | 8/1967 | Bobell | |
| 3,344,051 | A | 9/1967 | Latham | |
| 3,688,770 | A * | 9/1972 | O'Neill | 128/204.17 |
| 3,808,828 | A | 5/1974 | Kantor | |
| 3,981,627 | A | 9/1976 | Kantor | |
| 3,989,101 | A | 11/1976 | Manfredi | |
| 4,378,681 | A | 4/1983 | Modisette | |
| 5,275,006 | A | 1/1994 | McCutchen | |
| 5,335,143 | A | 8/1994 | Maling, Jr. et al. | |
| 5,412,950 | A | 5/1995 | Hu | |
| 6,050,326 | A | 4/2000 | Evans et al. | |
| 6,089,026 | A | 7/2000 | Hu | |

(Continued)

FOREIGN PATENT DOCUMENTS

| | | |
|---|---|---|
| DE | 698598 | 11/1940 |

(Continued)

OTHER PUBLICATIONS

Machine translation of DE 4103655 C1—Sumser; Aug. 1992.*

(Continued)

*Primary Examiner* — Cheryl J Tyler
*Assistant Examiner* — Justin Loffredo
(74) *Attorney, Agent, or Firm* — Bingham McCutchen LLP

(57) ABSTRACT

Heat pumps move heat from a source to a warmer sink, with Bernoulli heat pumps accomplishing this movement by reducing the temperature in a portion of the generally-warmer heat-sink flow. Heat flows spontaneously from the generally cooler heat-source flow into the locally cold portion of the heat-sink flow, which is the neck of a Venturi. The temperature reduction results from the Bernoulli conversion of random gas-particle motion (temperature and pressure) into directed motion (flow). This invention is a Bernoulli heat pump in which the heat transfer into the Venturi neck exploits unusual thermodynamic transport properties of rare-gases. Rare gases, especially mixtures of them, possess unusually small Prandtl numbers and thereby facilitate the diffusion of random particle motion (heat) relative to the diffusion of directed particle motion (viscosity), viscous friction being responsible for most of the power consumed by a Bernoulli heat pump.

15 Claims, 7 Drawing Sheets

Closed Duct-based Bernoulli Heat Pump

U.S. PATENT DOCUMENTS

| | | | | |
|---|---|---|---|---|
| 6,175,495 | B1 | 1/2001 | Batchelder | |
| 6,635,154 | B2 | 10/2003 | Johnson et al. | |
| 6,651,358 | B2 * | 11/2003 | Giacobbe | 34/428 |
| 6,659,169 | B1 | 12/2003 | Lopatinsky et al. | |
| 6,684,822 | B1 | 2/2004 | Lieggi | |
| 2003/0206796 | A1 | 11/2003 | Scholten | |

FOREIGN PATENT DOCUMENTS

| | | |
|---|---|---|
| DE | 4103655 | 8/1992 |
| DE | 4103655 C1 * | 8/1992 |
| JP | 3-124917 | 5/1991 |

OTHER PUBLICATIONS

Backhaus et al. "A thermoacoustic Stirling heat engine" Nature (May 27, 1999), vol. 399, pp. 335-338.

Tijani et al. "Prandtl number and thermoacoustic refrigerators" J. Acoust. Soc. Am. (Jul. 2002) 112, pp. 134-143.

International Preliminary Report on Patentability for PCT/IB2006/002176 issued on Feb. 12, 2008.

International Preliminary Report on Patentability for PCT/US2005/021462 issued on Dec. 20, 2006.

International Preliminary Report on Patentability for PCT/US2006/008428 issued on Sep. 12, 2007.

International Preliminary Report on Patentability for PCT/US2006/024633 issued on Dec. 24, 2007.

International Search Report for PCT/IB2006/002176, mailed on Jan. 30, 2007.

International Search Report for PCT/US2005/21462, mailed on Apr. 7, 2006.

International Search Report for PCT/US2006/08428, mailed on Oct. 24, 2006.

International Search Report for PCT/US2006/24633, mailed on Jan. 17, 2007.

* cited by examiner

RARE-GAS-BASED BERNOULLI HEAT PUMP AND METHOD

FIELD OF THE INVENTION

The present invention relates to heat pumps—devices that move heat from a heat source to a warmer heat sink—being more specifically directed to Bernoulli heat pumps and methodology.

BACKGROUND OF THE INVENTION

Heat engines move heat from a source to a sink. Heat engines can be divided into two fundamental classes distinguished by the direction in which heat moves. Heat spontaneously flows "downhill", that is, to lower temperatures. As with the flow of water, "downhill" heat flow can be harnessed to produce mechanical work, as illustrated by internal-combustion engines, e.g. Devices that move heat "uphill", that is, toward higher temperatures, are called heat pumps. Heat pumps necessarily consume power. Refrigerators and air conditioners are examples of heat pumps. Most commonly used heat pumps employ a working fluid (gaseous or liquid) whose temperature is varied over a range that includes the temperatures of both the source and sink between which heat is pumped. This temperature variation is commonly accomplished by compression of the working fluid. Bernoulli heat pumps effect the required temperature variation by exploiting the well-known Bernoulli principle, according to which random molecular motion (temperature and pressure) is converted into directed motion (macroscopic fluid flow) while leaving the total kinetic energy unchanged. Bernoulli conversion occurs most commonly when the cross-sectional area of a fluid flow is reduced, as in a Venturi-shaped duct wherein the cross-sectional area of fluid flow passes through a minimum along the flow path. The fluid may either be a gas or a liquid. Prior examples of such are described by C. H. Barkelew in U.S. Pat. No. 3,049,891, "Cooling by flowing gas at supersonic velocity", Oct. 21, 1960; and by V. C. Williams in U.S. Pat. No. 3,200,607, "Space Conditioning Apparatus, Nov. 7, 1963.

The directed motion must increase in order to maintain a constant mass flux as the cross-sectional area decreases, as in a garden-hose nozzle. Such conversion occurs spontaneously, that is without additional energy, by the local reduction of the random molecular motion, which is reflected in the temperature and pressure. Whereas compression consumes power, Bernoulli conversion does not. Though Bernoulli conversion itself consumes no power, the fluid nozzling usually implies strong velocity gradients within the heat-sink flow. Velocity gradients imply viscous losses. Thus, a challenge central to the development of Bernoulli heat pumps is the discovery and exploitation of structures and materials that facilitate heat transfer while minimizing viscous losses.

It has been found recently in thermoacoustic applications that mixtures of rare gases possess anomalously small viscosities. Discussion of this development and additional references can be found in M. E. H. Tijani, J. C. H. Zeegers, and A. T. A. M. de Waele, "Prandtl number and thermoacoustic refrigerators", Journal of the Acoustical Society of America, 112, No. 1, pp. 134-143, (July, 2002).

The conventional efficiency metric for heat pumps is the "coefficient of performance" (CoP) which is the ratio of heat-transfer rate to the power consumed. In a Bernoulli heat pump, the principal source of power consumption is viscous friction within the Venturi neck, where the flow velocity is greatest. Both the temperature difference driving the heat transfer and the viscous dissipation are proportional to the square of the flow velocity. Two properties of the working fluid are critical to the efficiency of a Bernoulli heat pump—its thermal conductivity and its viscosity. A dimensionless property of gases, called the Prandtl number, is fundamentally the ratio of these two properties. The CoP thus benefits directly from the use of materials characterized by small Prandtl numbers. The above-mentioned findings by Tijani et al in the context of thermoacoustic devices that mixtures of rare gases possess unusually small Prandtl numbers has now been applied in accordance the present invention, as a novel application of this finding to the improvement of the operation of Bernoulli heat pumps and methods.

OBJECTS OF THE INVENTION

A principal object of the invention, accordingly, is to provide a new and improved method of operating Bernoulli heat pumps and the like, and novel resulting pump apparatus, that provide efficient heat transfer while minimizing viscous fluid flow losses.

Another object is to provide for the novel use of rare gases, in Bernoulli heat pumps and, preferably, mixtures of such and other gases that provide gas constituents (atoms, molecules) of differing masses—relatively light and relatively heavy—that give rise to dramatically low Prandtl numbers in the fluid flow operation of the pumps.

Still another object is to provide such a novel Bernoulli heat pump wherein the heat transfer into the Venturi neck portion exploits the unusual thermodynamic transport properties of rare gases.

Other and further objects will be hereinafter described in detail and are more fully delineated in the appended claims.

SUMMARY OF THE INVENTION

In summary, however, from one of its broader aspects, the invention embraces in a Bernoulli heat pump wherein heat is transferred into a neck portion of nozzled heat-sink fluid flow, the method of balancing heat transfer and viscous losses, that comprises, flowing one or more rare gases through the neck as said heat-sink flow while heat is being transferred thereto.

From an apparatus viewpoint, the methodology of the invention may be practiced with a heat pump comprising

- a heat-source fluid flow,
- a heat-sink fluid flow in good thermal contact with said heat-source fluid flow,
- blower mechanisms that maintain said heat-source and heat-sink fluid flows,
- at least one solid duct of variable cross-section that imposes a Venturi shape on said heat-sink flow, and
- wherein said heat-sink fluid flow comprises, as a component, at least 1% mole-fraction rare gas.

Preferred and best mode designs are hereinafter fully described.

According to another aspect of the invention, the working fluid may be comprised of an elemental rare gas. Because the Prandtl number is proportional to the specific heat, which is, in turn, proportional to the number of degrees of freedom available in the working fluid to absorb energy, the Prandtl number is already relatively small for gases comprised of relatively simple particles. Gases comprised of the simplest particles are the rare gases. Thus, even the elemental rare gases have now proven to be attractive as working fluids for the Bernoulli heat pumps, and they are accordingly preferred for the purposes of the invention, taking advantage of these unusual thermodynamic transport properties of rare gases.

The present invention thus envisages Bernoulli heat pumps in which the heat-sink fluid flow—the "working fluid"—is indeed preferably comprised in significant part of a rare gas, or a mixture of rare gases, light and heavy; and, more generally, mixtures of relatively light and heavy gas components as later explained.

BRIEF DESCRIPTION OF THE DRAWINGS

The invention will now be described in connection with the accompanying drawings wherein:

FIG. 5, closed ductless Bernoulli heat pump useful with rare gas fluids and the like.

FIG. 6, annular turbine type pump appearing in FIGS. 2 and 5.

FIG. 6*a* top view of disk containing annular turbine

FIG. 6*b* side view of disk showing blades of annular turbine

DETAILED DESCRIPTION OF THE INVENTION

Figure 1:
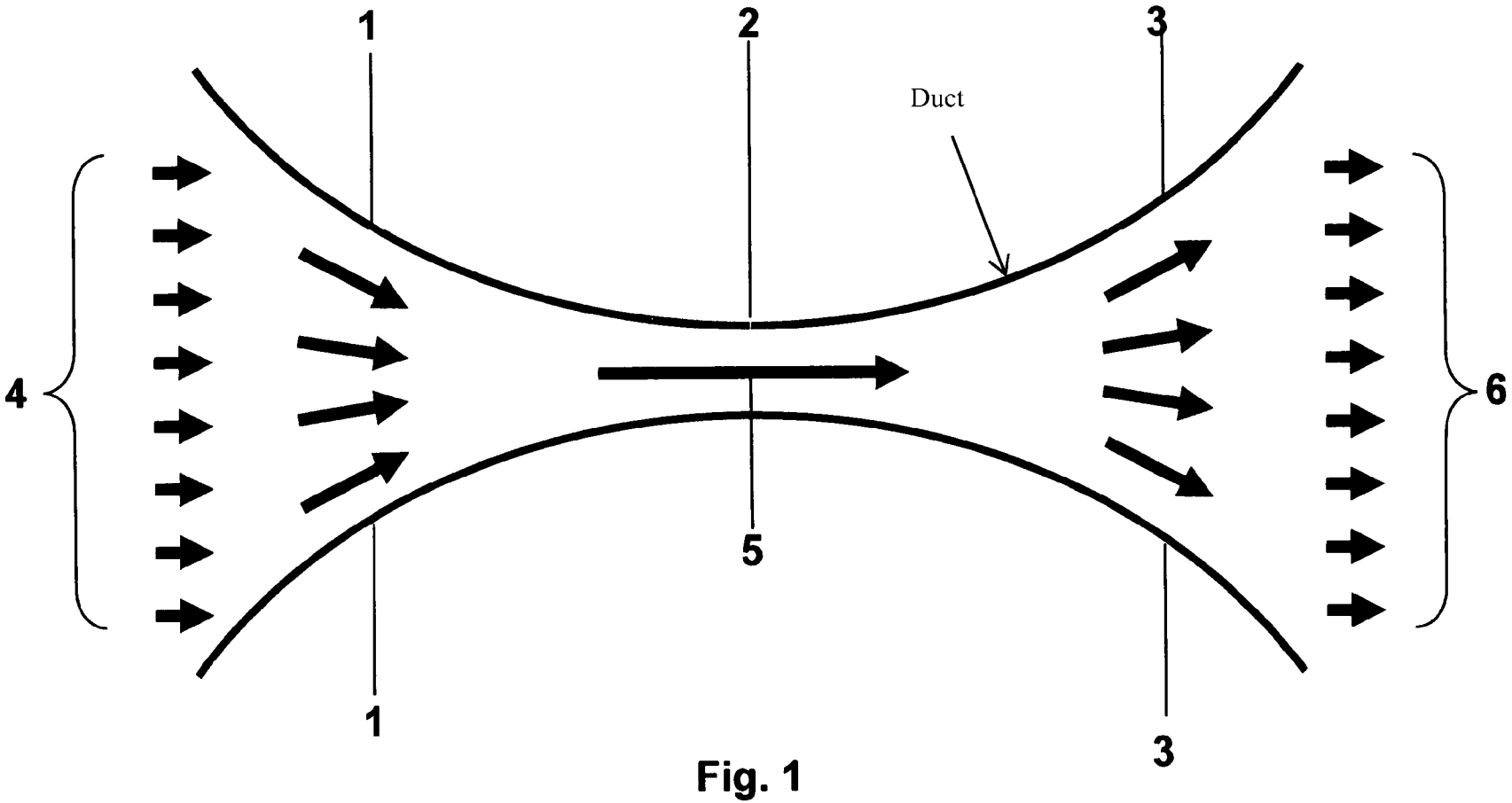
FIG. 1 is a cross-sectional view showing fluid temperature and speed in a Venturi nozzle in which preferably rare gases are a constituent of the fluid for the purposes of the invention.
Figure 7:
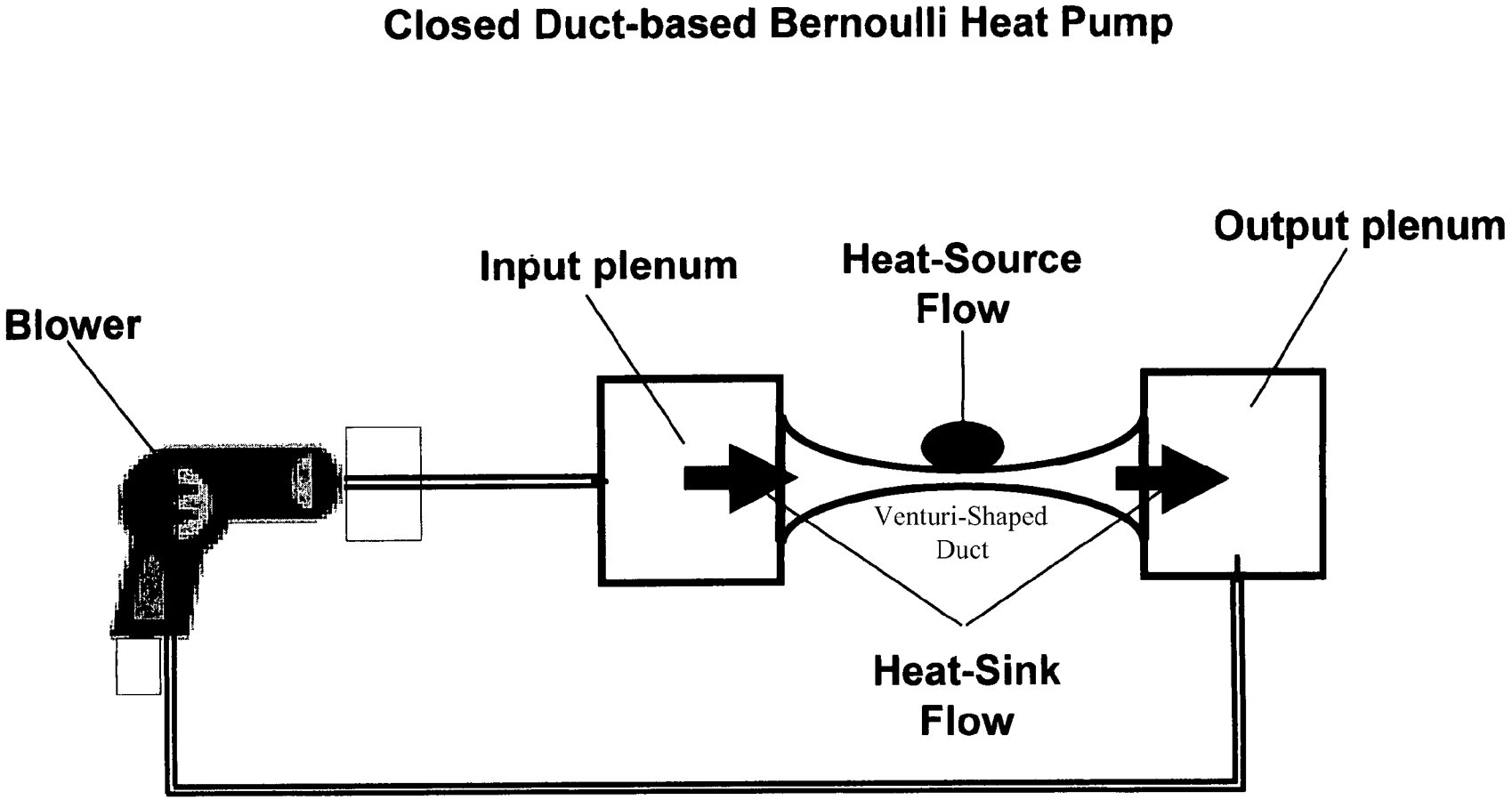
FIG. 7, closed duct-based Bernoulli heat pump for use with a rare gas fluid flow of the invention.

In the embodiments of the invention, a fluid flow is caused to adopt a Venturi shape, the generic form of which is shown in the varying cross-section solid duct of FIG. 1, comprising an entrance nozzle portion 1 of the Venturi duct into which a relatively slow hot fluid flow 4 is pressure-driven, converging into an intermediate neck portion 2 of reduced or decreased cross-section, with the flow 5 exiting through a diverging nozzle portion 3 as a relatively fast and cool fluid flow and wherein, in the diverging-nozzle or diffuser portion 3, Bernoulli conversion reverses, producing a slow flow 6 similar to that as the entrance 1, but heated by the heat transferred to the flow in the neck of the Venturi. Blowing mechanisms, as in FIG. 7, may be used to develop a pressure difference that maintains the heat-source and heat-sink fluid flows in good thermal contact, as are well-known; either to pull the heat-sink flow from the exit or exhaust or to push the heat-sink flow into the entry of the Venturi.

Figure 2:
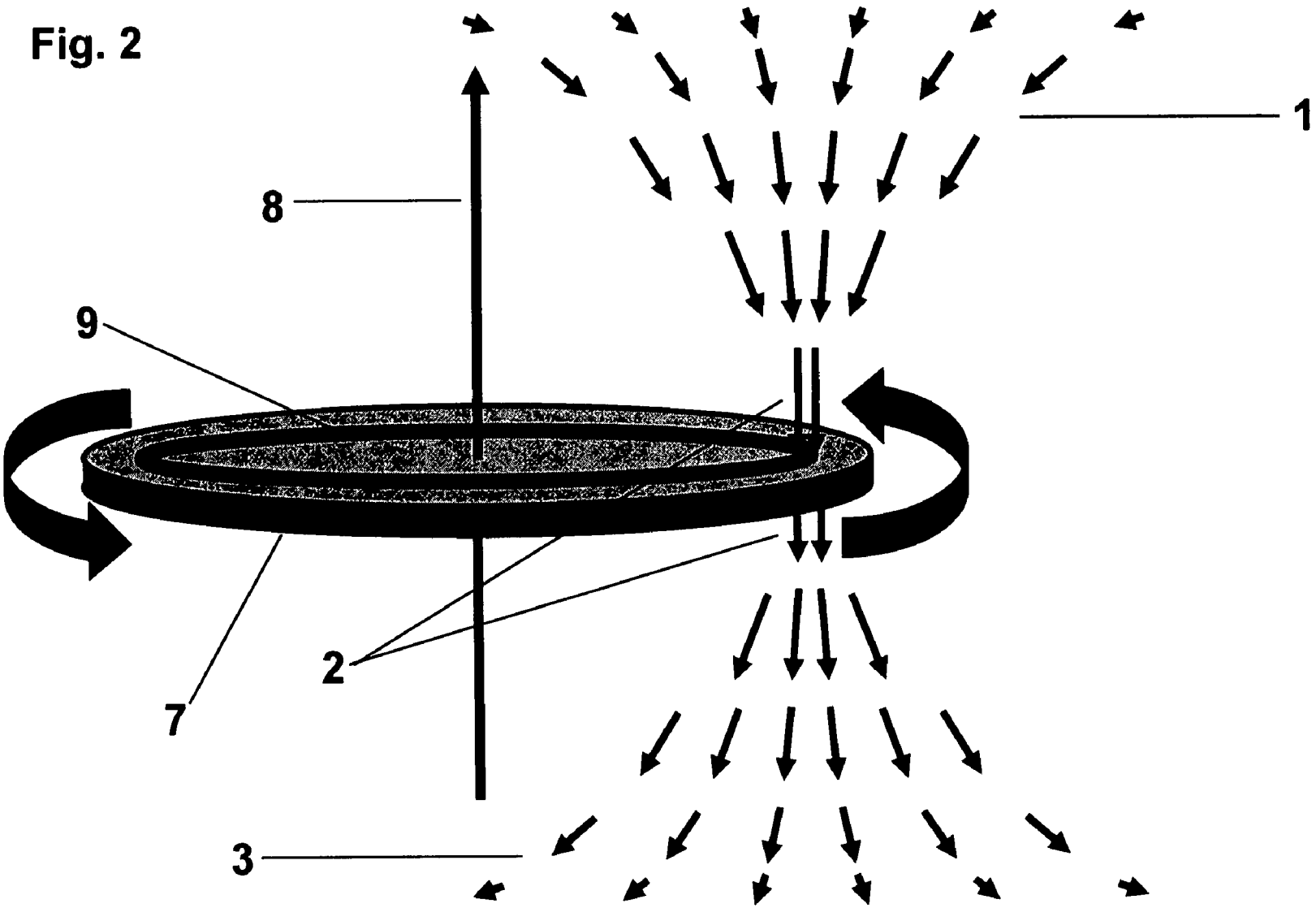
FIG. 2, self-forming Venturi configuring.
Figure 5:
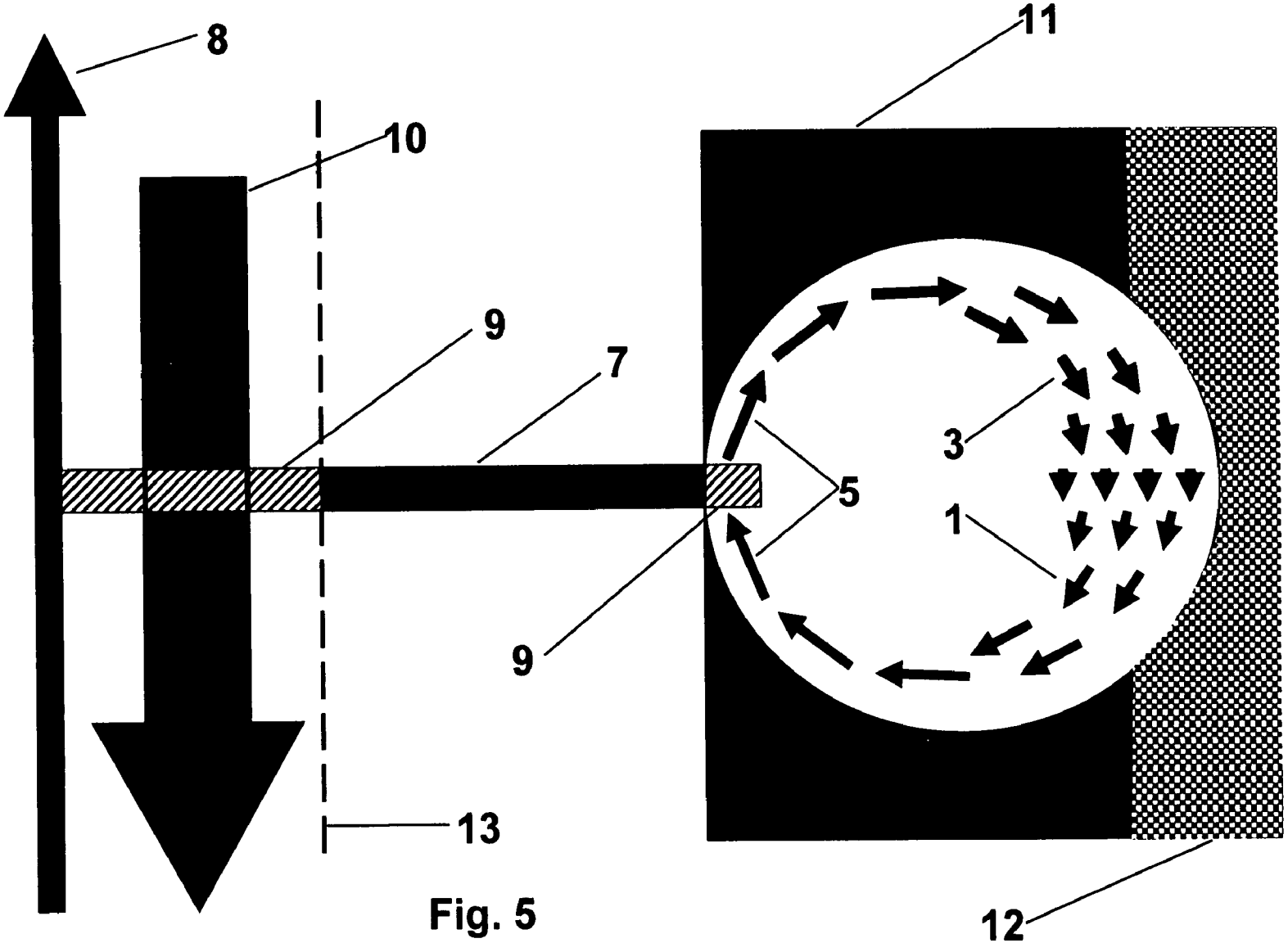
Figures 6A, 6B:
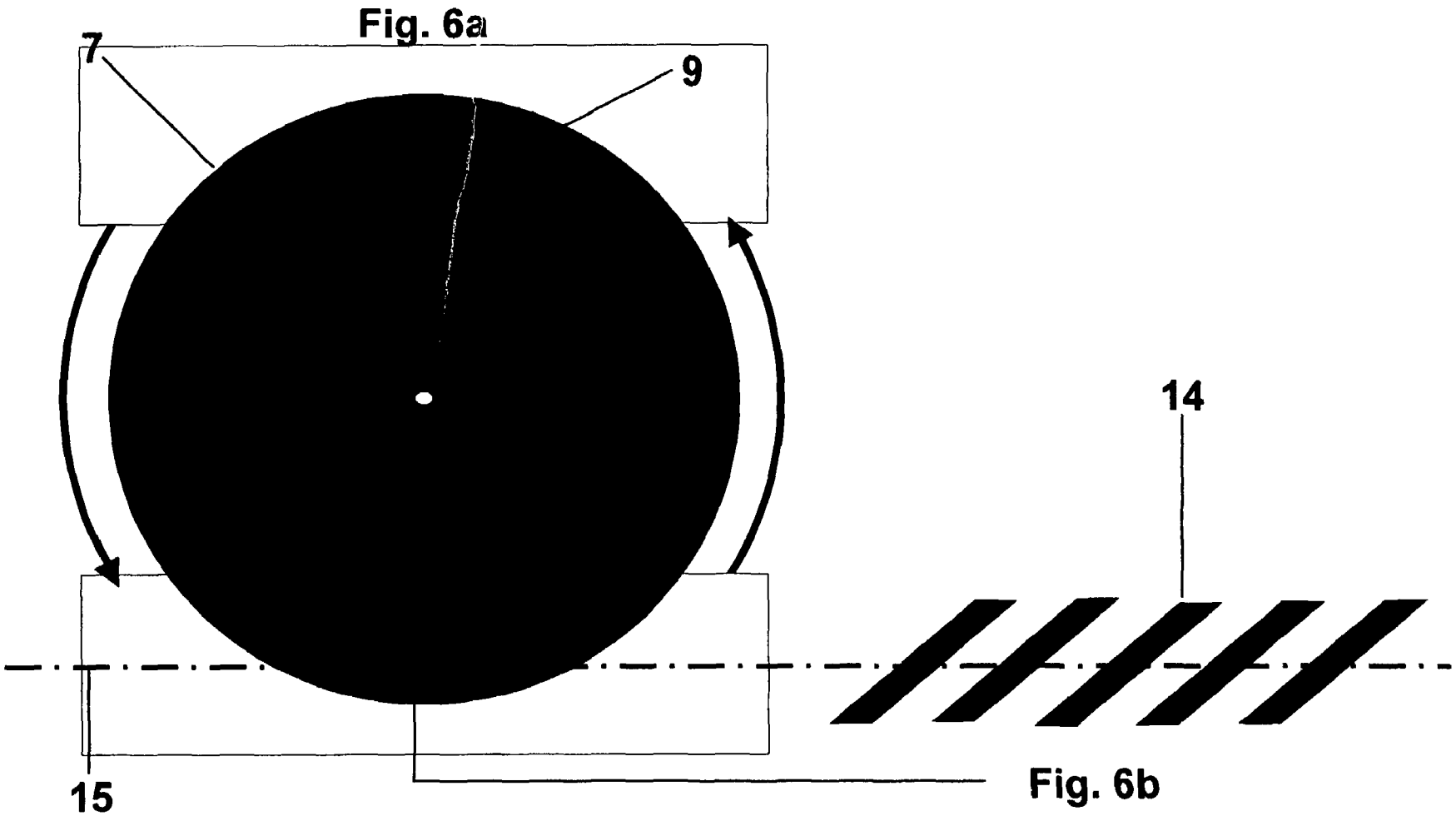

Alternatively, the nozzling can be a self-organized (duct-free) response of the fluid to a low-pressure region maintained by a pump. FIG. 2 illustrates such a self-forming Venturi wherein the flow is directed along an entering conversion "nozzle" portion 1 of a Venturi flow into a neck portion 2 and thence through a diverging "nozzle" portion 3. In this operation, an annular turbine 9 sustains flow through circumferential apertures in a disc 7 rotating about the vertical axis 8, and shown more particularly in FIGS. 6*a* and *b*, wherein the dashed line 15 represents the plane of a side view. Blades of the annular turbine 9 are shown at 14 in FIG. 6*b*. A stator 11, FIG. 5, isolates the heat-sink flow and provides a stator heat exchanger 12 that removes heat from the heat-sink flow. The heat-source flow is indicated at 10, parallel to the rotation axis 8 of the rotating disc 7 as the annular turbine 9 sustains flow through the disc apparatus in this closed ductless Bernoulli-operating heat pump configuration.

The Venturi can be fundamentally either one or two dimensional. For example, the flow through a garden-hose nozzle can be characterized as fundamentally one dimensional with a line of flow. On the other hand, the configuration schematized in FIG. 1 can extend into the third dimension perpendicular to the plane of FIG. 1. to create a two-dimensional Venturi, nozzle and sheet of flow. The required nozzling can be achieved by using a pressure difference to drive the fluid through the duct of varying cross-section.

Figure 3:
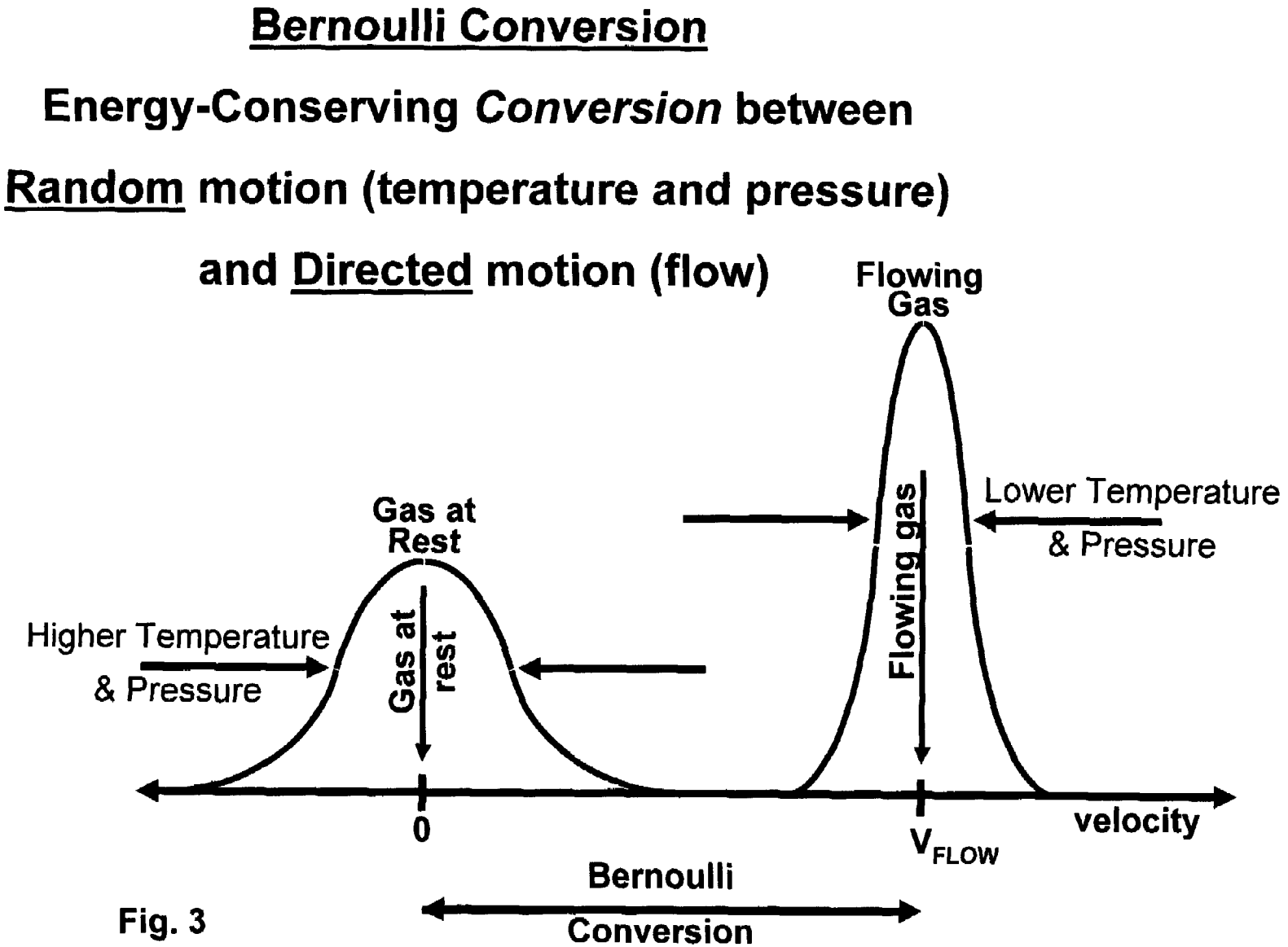
FIG. 3, Bernoulli conversion diagram of random-to-directed motion.

In all cases, however, nozzling is central to the operation of a Bernoulli heat pump because mass conservation requires that the flow velocity increase so as to maintain a constant mass flux through the decreasing cross-sectional area. The "magic" of Bernoulli's principle is that the energy increase represented by the increased flow speed is obtained at the expense of the energy associated with the random motion of the fluid particles. That is, as the flow speed increases, the temperature and pressure decrease. FIG. 3 shows that Bernoulli conversion can be described in terms of the velocity distribution of the fluid particles. In terms of this distribution, the mean (flow speed) is increased at the expense of the variance (temperature).

Figure 4:
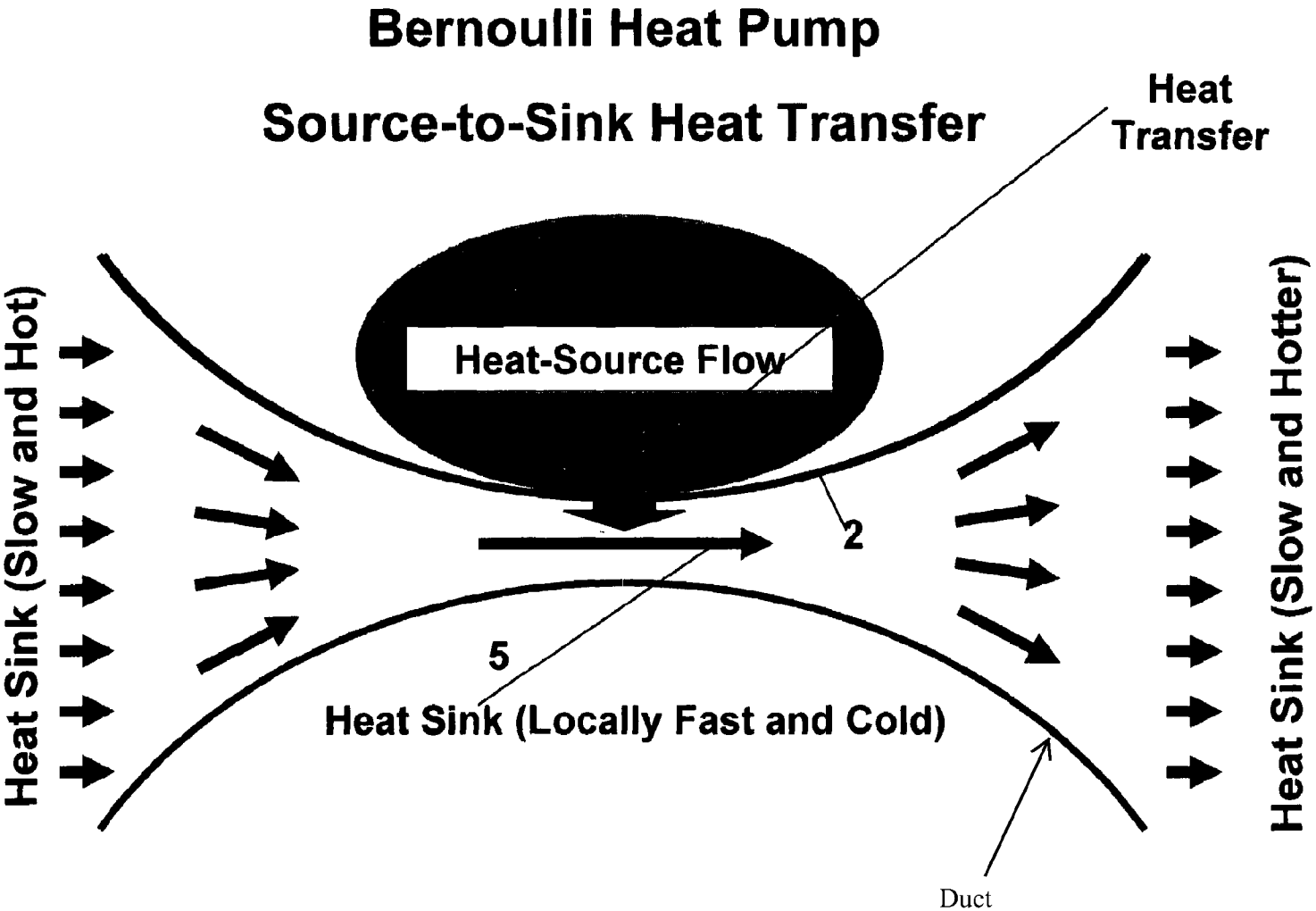
FIG. 4, a preferred heat pump of the invention wherein heat transfer from heat-source flow to the neck of the heat-sink Venturi of FIG. 1 provides pumping useful with the preferred rare gas method flow of the invention.

A nozzle becomes a heat pump when we allow a second fluid flow, the heat-source flow, to transfer heat into the Bernoulli-cooled necks of the nozzled heat-sink flow 5. One such configuration is shown in FIG. 4 wherein the heat-source flow is directed perpendicular to the plane of the diagram.

A fundamental challenge presented by the Bernoulli heat pump concerns the transfer of heat into the neck of the nozzled heat-sink flow. This is a challenge because thermal equilibration eliminates the relative motion of the heat-sink flow and the solid in the immediate vicinity of the fluid-solid interface. This is the so-called "no-slip boundary condition". While the solid can conduct heat from the source flow to the interface with the sink flow, in order to be convected away by the heat-sink flow, the heat must traverse the boundary layer that separates the solid and cold core of the sink flow. Although the boundary layer is very thin, the fluid constituting the layer is neither rapidly moving nor necessarily cold.

To traverse the boundary layer, heat must be conducted (that is, diffuse) through the boundary layer. The thickness of the boundary layer is governed by the viscosity of the sink-flow fluid, and the effectiveness of the thermal conduction is governed by its thermal conductivity. It is therefore not surprising that the dimensionless ratio of the working fluid viscosity to its thermal conductivity is an important design parameter.

The operation of a Bernoulli heat pump thus represents the competition between two similar physical effects. Both effects, thermal conductivity and viscosity, reflect the diffusion of a macroscopic property within the heat-sink flow. The two differ only in the macroscopic property that diffuses. Perhaps not surprisingly, the two relevant diffusing quantities are those connected by Bernoulli conversion; that is, random and directed particle motion. Thermal conductivity is the diffusion of temperature (random motion), while viscosity is the diffusion of flow velocity (directed motion). Thermal conductivity controls the benefit (heat transfer), while viscosity controls the cost of the consumed heat (viscous losses). The ratio of the benefit to the cost, as previously mentioned, is called the "coefficient of performance" (CoP) and is fundamentally proportional to the ratio of thermal conductivity to viscosity, which is the inverse of the earlier-discussed dimensionless gas property called the "Prandtl number".

As also before mentioned, recent studies by the earlier-referenced Tijani et al particularly directed to thermoacoustic refrigeration, have shown that mixtures of appropriately employed rare gases possess anomalously small Prandtl numbers. This raised the thought that perhaps such mixtures may also be attractive candidates for the role of working (heat-sink) fluid in Bernoulli pumps. The critical property of such mixtures is the mass difference of the constituent rare-gas atoms and molecules. For example, the atomic mass of xenon is more than thirty times that of helium. Also, the variation of the Prandtl number with the relative concentration of the light and heavy atoms is dramatically nonlinear. That is, the Prandtl number of the mixture is dramatically lower than would be anticipated on the basis of any sort of simple averaging of the Prandtl numbers of the pure gases. For the purposes of the present invention, the heat-sink fluid flow preferably comprises as a component, at least 1% mole-fraction rare gas—a single rare gas element, or a combination of two or more rare gases such as the before-mentioned heavier xenon and lighter helium, or a mixture of helium and one or more heavier rare-gas elements, and the like.

Rare gases are also attractive as the working fluid for use in Bernoulli heat pumps in accordance with the methodology of the present invention simply also because they are inert. Thus, their release into the atmosphere has none of the negative implications of conventional coolants.

Rare gases are also attractive as the working fluid for Bernoulli heat pumps of the invention because the individual atoms comprising the gas possess no internal structure capable of absorbing energy in the temperature range of interest. The number of such degrees of freedom enters directly into the specific heat which, in turn, enters both the Prandtl number and the temperature decrease associated with a given flow speed.

Whereas the use of a common fluid, such as ambient air, for both the source and sink flows allows a Bernoulli heat pump to operate as an open system, the use of rare gases or rare-gas-based mixtures implies that the system must be closed. That is, the heat-sink flow must operate in a closed cycle in which heat is transferred from the heat-sink flow to another heat sink, before returning to the Venturi. Examples of such closed systems are illustrated in FIGS. 5 and 6, above-described.

Further modifications will occur to those skilled in this art, and such are considered to fall within the spirit and scope of the invention as defined in the appended claims.

What is claimed is:

1. A method of balancing heat transfer and viscous losses in a Bernoulli heat pump, the method comprising the steps of:

providing the Bernoulli heat pump comprising a first flow path through a neck portion defined by at least one venturi-shaped boundary wall;

providing a heat source external to and in thermal communication with the venturi-shaped boundary wall; and flowing a closed-loop heat-sink flow comprising one or more rare gases and having at least 1% mole-fraction of rare gas through the first flow path of the neck portion, thereby transferring heat from the heat source to the heat-sink flow through the venturi-shaped boundary wall.

2. The method of claim 1 wherein the rare gas component comprises at least 1% mole-fraction of a rare-gas element.

3. The method of claim 1 wherein the rare-gas component comprises a mixture of a plurality of rare-gas elements.

4. The method of claim 1 wherein the heat-sink flow comprises a mixture of helium and one or more heavier rare-gas elements.

5. The method of claim 1 wherein the heat-sink flow comprises two or more gas element components, at least one of the two gas element components having a larger mass than another of the gas element components.

6. The method of claim 1 wherein the heat-sink flow is maintained by a pressure difference caused by pushing on the flow.

7. The method of claim 1 wherein the heat-sink flow is maintained by a pressure difference caused by pulling on the flow.

8. The method of claim 1 wherein heat is transferred from the heat-sink flow to another heat sink before returning to the original heat-sink flow.

9. The method of claim 1, wherein the heat source comprises a second flow path external to the venturi-shaped boundary wall.

10. The method of claim 1, wherein the heat-sink flow is driven by at least one blower mechanism.

11. The method of claim 1, wherein the Bernoulli heat pump comprises at least one duct.

12. A method of balancing heat transfer and viscous losses in a Bernoulli heat pump, the method comprising the steps of:

providing the Bernoulli heat pump comprising a first flow path through a neck portion defined by at least one venturi-shaped boundary wall;

providing a heat source external to and in thermal contact with the venturi-shaped boundary wall; and flowing a closed-loop heat-sink flow comprising a mixture of gas element components, said mixture having at least 1% mole-fraction of rare gas and at least two of the gas element components having different masses, through the first flow path of the neck portion, thereby transferring heat from the heat source to the heat-sink flow through the venturi-shaped boundary wall.

13. The method of claim 12, wherein the heat source comprises a second flow path external to the venturi-shaped boundary wall.

14. The method of claim 12, wherein the heat-sink flow is driven by at least one blower mechanism.

15. The method of claim 12, wherein the Bernoulli heat pump comprises at least one duct.

* * * * *